US009874065B2

(12) United States Patent
Christensen

(10) Patent No.: US 9,874,065 B2
(45) Date of Patent: Jan. 23, 2018

(54) DUAL STRIPPER APPARATUS

(71) Applicant: AKER SOLUTIONS AS, Lysaker (NO)

(72) Inventor: Kim W. Christensen, Hyggen (NO)

(73) Assignee: AKER SOLUTIONS AS, Lysaker (NO)

( * ) Notice: Subject to any disclaimer, the term of this patent is extended or adjusted under 35 U.S.C. 154(b) by 0 days.

(21) Appl. No.: 15/128,581

(22) PCT Filed: Mar. 24, 2015

(86) PCT No.: PCT/NO2015/050053

§ 371 (c)(1),
(2) Date: Sep. 23, 2016

(87) PCT Pub. No.: WO2015/147649

PCT Pub. Date: Oct. 1, 2015

(65) Prior Publication Data

US 2017/0191339 A1 Jul. 6, 2017

(30) Foreign Application Priority Data

Mar. 25, 2014 (NO) ..... 20140379

(51) Int. Cl.
*E21B 17/01* (2006.01)
*E21B 33/064* (2006.01)
(Continued)

(52) U.S. Cl.
CPC ..... *E21B 33/064* (2013.01); *E21B 17/01* (2013.01); *E21B 33/035* (2013.01);
(Continued)

(58) Field of Classification Search
CPC ..... E21B 17/01; E21B 33/035; E21B 33/064; E21B 33/072; E21B 33/076; E21B 43/128
See application file for complete search history.

(56) References Cited

U.S. PATENT DOCUMENTS 5,988,274 A 11/1999 Funk
6,102,125 A * 8/2000 Calder ..... E21B 33/035 166/242.2

(Continued)

FOREIGN PATENT DOCUMENTS

GB 2320269 A 6/1998
GB 2347156 A 8/2000

*Primary Examiner* — Matthew R Buck
(74) *Attorney, Agent, or Firm* — Birch, Stewart, Kolasch & Birch, LLP

(57) ABSTRACT

A workover riser arrangement designed to allow installation/retrieval of a coiled tubing suspended Electrical Submersible Pumps (ESP) into live wells is described. The installation takes place by the use of a coiled tubing as a running string that extends through respective apparatuses in said workover riser arrangement and further down towards the well bottom. The workover riser apparatus comprises a first (upper) dual stripper apparatus through which said coiled tubing is to extend, a second (lower) dual stripper apparatus through which said coiled tubing is to extend, a surface BOP, if required, and a surface flow tree arranged between the first and second dual stripper apparatus, an EDP, LRP and an XMT arranged below the second dual stripper apparatus.

20 Claims, 12 Drawing Sheets

(51) Int. Cl.

| | |
|---|---|
| ***E21B 33/035*** | (2006.01) |
| ***E21B 33/076*** | (2006.01) |
| ***E21B 43/12*** | (2006.01) |
| *E21B 33/072* | (2006.01) |

(52) U.S. Cl.
CPC ..... *E21B 33/076* (2013.01); *E21B 43/128* (2013.01); *E21B 33/072* (2013.01)

(56) References Cited

U.S. PATENT DOCUMENTS

| | | | | |
|---|---|---|---|---|
| 6,328,111 | B1 * | 12/2001 | Bearden | E21B 23/00 166/106 |
| 8,127,854 | B2 * | 3/2012 | Haheim | E21B 19/004 166/339 |
| 8,443,878 | B2 * | 5/2013 | McCollin | E21B 33/08 166/84.1 |
| 8,714,261 | B2 * | 5/2014 | Sbordone | E21B 33/076 166/338 |
| 9,091,137 | B2 * | 7/2015 | Pettersen | E21B 19/004 |
| 2009/0151956 | A1 * | 6/2009 | Johansen | E21B 33/076 166/350 |
| 2009/0314499 | A1 | 12/2009 | Bussear et al. | |
| 2010/0270746 | A1 * | 10/2010 | Van Winkle | E21B 33/076 277/322 |
| 2010/0314122 | A1 * | 12/2010 | Sbordone | E21B 33/076 166/345 |
| 2014/0158380 | A1 * | 6/2014 | Varkey | E21B 33/08 166/386 |

* cited by examiner

1. Both stripper boxes are open.
2. EDP/LRP valves closed.
3. ESP lowered to above EDP.

1. Close upper dual stripper (or lower, depending on location in stack)
2. Pressurize riser to well pressure.
3. Open EDP/LRP valves
4. Lower ESP through EDP/LRP 1. ESP is lowered until Hanger Plug gets to the upper dual stripper box.

1. Lower dual stripper box closes around the CT.
2. The riser between the two stripper boxes are bled off and circulated to MEG.

1. The upper dual stripper box is opened.
2. The Hanger Plug with running tools is lowered past the upper dual stripper box.

1. The upper dual stripper box is closed.
2. The pressure between the stripper boxes is increased to equalise the well pressure.

1. Open the lower dual stripper box.
2. Lower the Hanger Plug with running until it lands in the XT.
3. Lock Hanger Plug to XT.

1. Retrieve the running tool above the EDP/LRP.
2. Close the EDP/LRP valves
3. Bleed off and circulate the riser to MEG.
4. Open upper dual stripper box and retrieve CT and running tool to surface.

DUAL STRIPPER APPARATUS

The present invention relates to a workover riser arrangement designed to allow installation/retrieval of a coiled tubing suspended Electrical Submersible Pump (ESP) into live wells defined by the internal walls of a production tubing, by use of a coiled tubing as a running string to be extended through respective apparatuses in the workover riser arrangement and further down towards the well bottom.

The present invention is designed and developed for use in workover operations. In a normal production system, oil is pumped from a reservoir via subsea equipment to a production vessel/rig. A large production pipe is placed into the hole running from the reservoir to the sea bed. Later on, the end of such pipe is perforated to obtain fluid communication. This functions as a straw oil can run through. Equipment is installed on the seabed to control the potentially large pressures in the reservoir. This equipment both controls the pressure from the reservoir and the production flow to the topside vessel.

After some time, old wells will underperform because of build-up in pipelines, old equipment, etc. The workover system's main function is to allow access for tooling that can perform operations to increase the productive life of wells by repairing damaged or underperforming wells.

A workover system is also relevant in terms of new oil/gas discoveries because the system is also used after drilling to complete the well (getting the well ready for production).

When drilling in the North Sea started in the early 1970's, the recovery rate of oil from the reservoirs was as low as 16-17%. The recovery rate is a ratio between what you successfully get out of the reservoir and the total amount of oil/gas in the reservoir. Advancements in technology have increased this recovery rate in some cases to as much as 65%. With further development of technology, this recovery rate will increase. One major challenge is the large depth at which new subsea installations are placed.

As indicated, workover is important for all wells (not only subsea) to increase oil recovery and perform service and maintenance. Because of the difficulties regarding accessibility of subsea XMTs, there is a drive in the industry to develop faster and more reliable means for subsea workover. Three factors are especially important:

1. Rig or vessel cost
2. Unproductive time when the well is being worked on
3. Size and weight of equipment Workover systems are usually divided into three categories:

1. Category A—Riser Less Workover
2. Category B—Workover with Workover Riser
3. Category C—Workover with Marine Riser The present invention is concerned with the workover system in Category B—Workover with Workover Riser. Workover with a workover riser is used for slightly more complex tasks than Category A and uses a workover riser to access the well. A drilling rig, workover rig or a purpose built ship is required. Tools can be lowered and hoisted through the riser in order to perform different tasks in the well. This type of workover is often called open-water workover. Typical operations are wireline and coiled tubing operations.

An Electrical Submersible Pump (ESP) is a pump that is placed down hole in a well, below the seafloor, to boost the oil recovery from such well. It is typically 60 m long with a weight of approximately 3 tons. One method of ESP arrangement is when the power cables have been routed and clamped external to the production tubing (completion). The ESP is then landed in the production tubing or in a docking station inside the tubing. The power is fed through the production tubing to the ESP.

Alternatively new ideas and patents have been presented describing an ESP solution where the power cable is routed on the inside of the production tubing inside a length of Coiled Tubing (CT). The ESP is suspended from the CT and the CT is hung from a plug secured in an X-mas Tree (XT). The ESP, the power cable inside the CT and the Hanger Plug (HP) are typically ran also by CT by means of a Running Tool (RT). A typical distance from the XT to the ESP is 3000 m meaning that the power cable and the CT need to be 3000 m as well. An appended illustration (FIG. 4) shows the system as installed.

Installing the ESP by means of the RT can be a challenge. The reason for this is illustrated in a second appended illustration (FIG. 5.). In brief, due to the variable diameter, the HP cannot pass through a conventional stripper box (or injector head) which is the pressure containing element in a normal CT operation. Further, it is to be noted that the pressure in the well will be inside the production tubing, the workover riser and all the way up to the dual stripper apparatus.

In order to install the internal cabling system as per FIG. 3 in a safe manner, it is with today's technology required to close the well below the ESP hang off point (dead well). This is typically done using some sort of a valve, either hydraulically/electrically or mechanically operated. Before the well can be opened for installing or retrieving the ESP with the power cable, the entire production tubing will need to be bled off and circulated with MEG (monoethylene glycol) or similar, which is a time consuming operation, in order to prevent any oil or gas emerging.

The reliability of the down hole valve can also be questioned, especially when the ESP shall be retrieved and replaced. After producing e.g. for 3 years, it is a high possibility that the valve will not function as intended. Without the valve closed it is no longer possible to close the well, and more drastic measures are required like killing the well with heavy fluid or bullheading the well, which is very time/cost consuming and could potentially damage the reservoir.

The present invention was developed to enable safe ESP installation on a live well using open water workover system. This will eliminate the need for circulating the production tubing, and the system is no longer dependent on a potentially unreliable down hole valve.

Thus the problem forming the basis for the invention is being solved by means of a workover riser arrangement of the introductory said kind, which arrangement is distinguished in that said arrangement comprises a first (upper) dual stripper apparatus through which said coiled tubing is to be extended, a second (lower) dual stripper apparatus through which said coiled tubing is to be extended, a surface BOP, if required, and a surface flow tree arranged between the first and second dual stripper apparatus, an EDP, LRP and an XMT arranged below the second dual stripper apparatus.

According to the present invention, the upper and lower dual stripper apparatuses are designed to both seal against a slick line, such as a coiled tubing string, and still being able to let through an object of larger diameter, each apparatus comprises two independent seal blocks, said seal blocks being located adjacent to each other and retaining respective split seals that are spaced a distance apart from each other and leaving a cavity therebetween, which cavity is in communication with grease supply means in order to fill said cavity with grease and pressurize said cavity to form a dual seal.

In one embodiment, the upper and lower dual stripper apparatuses include two independent seal blocks, which seal blocks are dived in two halves, each half being moveable towards and away from each other.

In one embodiment, each seal half is moveable by means of respective pipe rams.

Further, each seal can be a dynamic seal able to dynamically seal against well pressure.

Preferably, the ESP has a connected power/signal cable extending inside the coiled tubing between the hanger plug and ESP. Further, an isolation plug can be connected to a plug running tool and a hanger plug, which is suspended in the XMT when installed.

One of the stripper boxes should preferably be placed at a distance above the EDP valve at least equal to the length of the ESP, in order to enable lowering the ESP through EDP/LRP while keeping pressure control with the stripper box above the ESP.

Further, the spacing between the two dual stripper boxes should preferably be equal to or greater than the length of the Hanger Plug and the Hanger Plug Running Tool, in order to enable sluicing through the plug and running tool while keeping pressure control with one of the stripper boxes.

The present invention also relates to a method for installing a coiled tubing suspended Electrical Submersible Pump (ESP) into live wells defined by the internal walls of a production tubing, which method uses a coiled tubing string as a running string to be extended through a workover riser arrangement and further down towards the well bottom, which workover riser arrangement includes a first (upper) dual stripper apparatus through which said coiled tubing is to extend, a second dual stripper apparatus through which said coiled tubing is to extend, a surface BOP, if required, and a surface flow tree arranged between the first and second dual stripper apparatus, an EDP, LRP and an XMT arranged below the second dual stripper apparatus, which method comprising the following steps: 1) lowering the ESP through the upper dual stripper apparatus while both upper and lower dual stripper apparatuses are open and EDP/LRP valves are closed and ESP is lowered to above the EDP; 2) closing the upper dual stripper apparatus, pressurize riser to well pressure, open EDP/LRP valves and lowering ESP through EDP/LRP; 3) continue the lowering of ESP until a hanger plug arrives at the upper dual stripper apparatus; 4) the lower dual stripper apparatus closes around the CT while the riser between the upper and lower dual stripper apparatuses are bled off and circulated with MEG; 5) the upper dual stripper apparatus is opened, the hanger plug with associated running tool is lowered through and past the upper dual stripper box; 6) the upper dual stripper apparatus is closed, the pressure between the upper and lower dual stripper apparatuses is increased to equalize the well pressure; 7) the lower dual stripper apparatus is opened, the hanger plug and running tool is lowered until the hanger plug is landed in the XMT, and the hanger plug is locked to the XMT.

Preferably the method further includes a step 8 in order to retrieve the running tool above the EDP/LRP, close the EDP/LRP valves, bleed off and circulate the riser with MEG, and finally open the upper dual stripper apparatus and retrieve CT and running tool to the surface.

At the end of this description, a list of abbreviations used in this specification can be found.

EXAMPLE OF EMBODIMENT

While the various aspects of the present invention have been described in general terms above, a more detailed and non-limiting example of an embodiment will be described in the following with reference to the drawings, in which.

Figure 1:
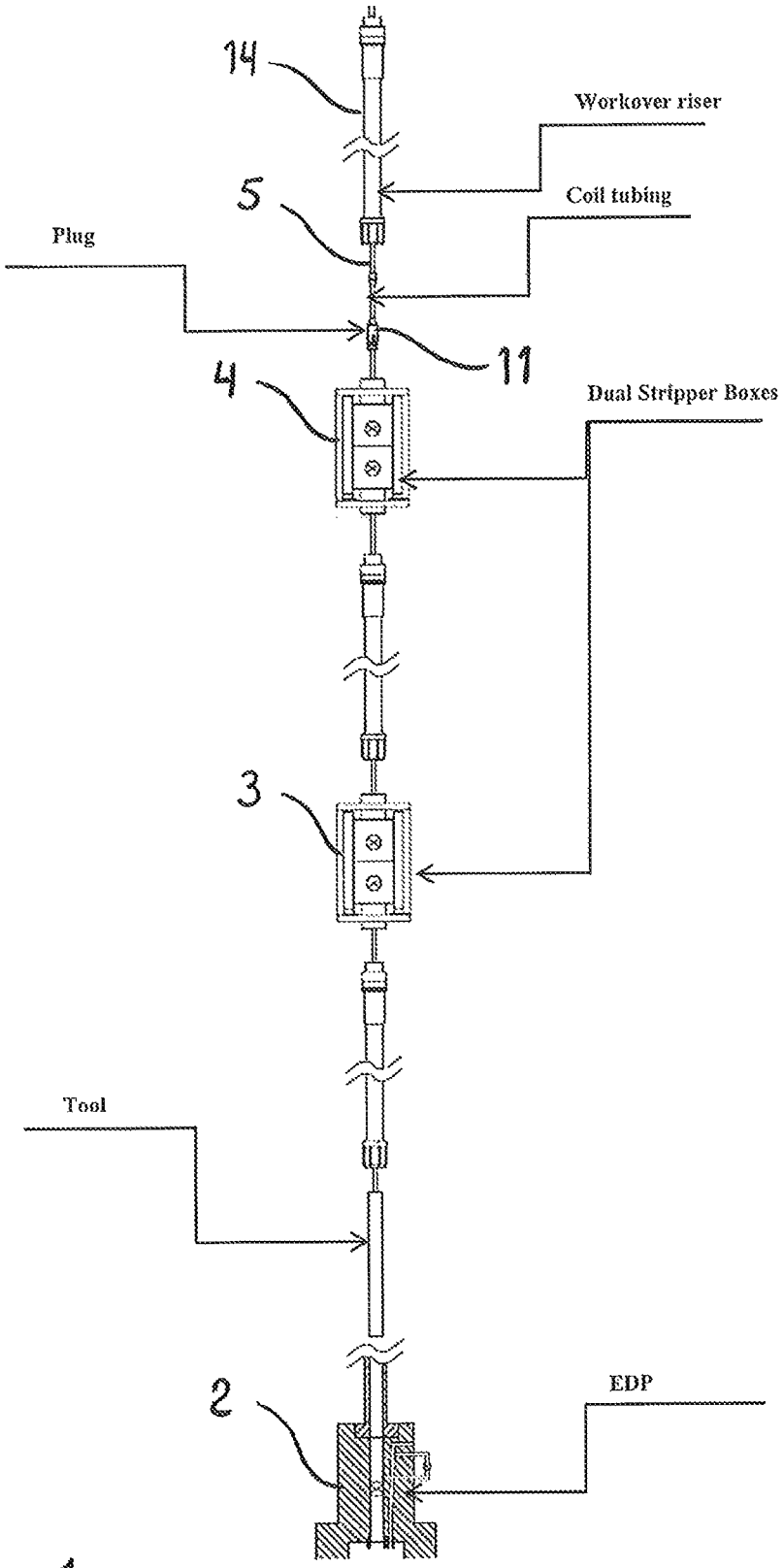
FIG. 1 is a schematic view of a workover arrangement involving the present invention.

A workover arrangement, also termed a workover system (WOS), is an advanced system consisting of several components. As already indicated, its main tasks is to get a drilled well ready for operation so it can start to produce oil, alternatively, or in addition, to perform maintenance and intervention on existing wells.

A workover control system (WOCS), controls the whole workover system and is controlled from a control room on the rig. Umbilicals (advanced cables) supply power and communications to the different components of the system. The control system provides safe and effective control of the workover system. Operators on the rig monitor the different operations from the control room. Electric and hydraulic power is distributed through umbilicals to control and operate equipment.

A surface flow tree (SFT) is placed on top of the workover riser. The main purpose of the SFT is to allow for test production and to "kill" a well if required. It consists of a certain set of valves and provides the last barrier of the workover system. Tools that can be used in the well have to be lowered and hoisted through the SFT. The SFT is installed to increase safety (barrier element) with and without pressure in the riser. The SFT is operated both remotely and manually. Tools are prepared and lowered into the SFT to do well intervention tasks.

Further, an interface to rig tensioning apparatus is required to enable top tensioning of the complete workover riser system during operations. The SFT is arranged with valves used for circulation of fluids, pressure, production testing, and operations. The typical arrangement: 1) Surface tree production wing valve (SPWV); 2) Choke/kill valve (CKV) and 3) production Swab valve (PSV).

The workover riser is a pipe that extends from the rig to the equipment on the seabed with potential lengths of more than a thousand meters. The diameter is large enough to lower and hoist tools through it. In simple terms: the riser functions as a conduit for the different workover tools in order to reach equipment on the bottom of the sea. It is to be understood that without a riser there is no way for the tools to reach the equipment on the seabed. Moreover, as it is difficult and inconvenient to have a pipe of these lengths on the rig, the riser is divided into shorter segments. They are stacked together on the rig and lowered into the sea in order to reach the desired depth.

A lower workover riser package (LWRP) is installed on top of the well to control the pressure in the reservoirs. The LWRP includes different valves that can shut off the well if something unexpected happens and thus functions as a backup, also called second barrier. During an emergency it is also possible to disconnect this equipment from the well. In brief, the workover operations will not be performed in a safe and controlled way without a LWRP. Such LWRP is installed subsea and controlled from the control room on the rig through umbilicals.

The LWRP is assembled by an upper emergency disconnect package (EDP) and a lower riser package (LRP) or (WCP). The main function of the EDP is to provide a safe and quick way to disconnect from subsea equipment if an emergency arises. The riser is connected directly to the top of the EDP. The LRP includes different valves that can both cut and seal off the well flow in an emergency. In turn, the LRP locks onto the subsea XMT and functions as a subsea blowout preventer.

Figure 2:
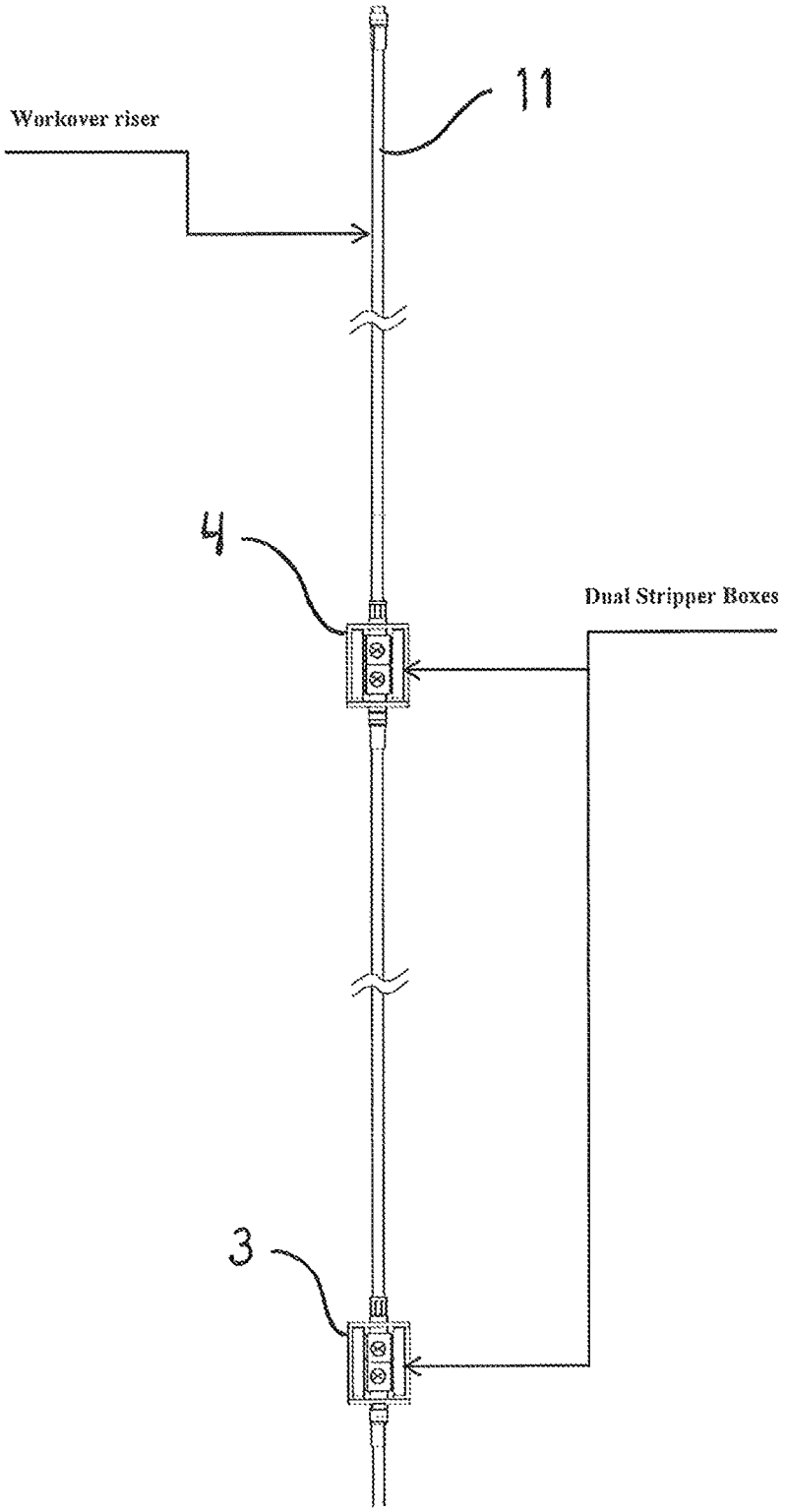
FIG. 2 is a schematic view of the dual stripper boxes applied for open water workover arrangements according to the present invention.
Figure 5:
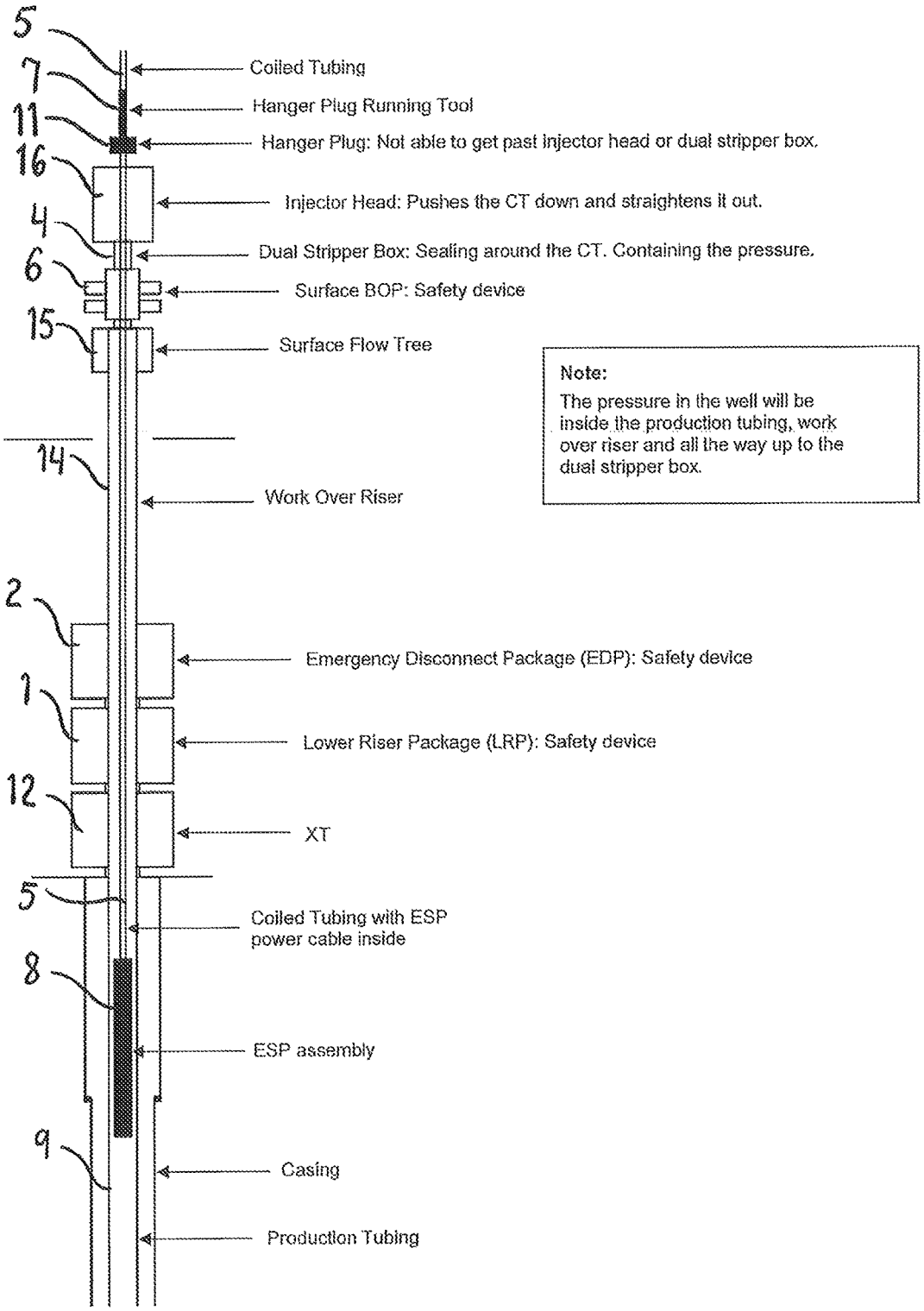
FIG. 5 is a schematic overall view of the workover arrangement in combination with the tubing string.

Reference is now made to FIGS. 1 and 2 to describe a workover arrangement in more detail. FIG. 1 shows a workover system according to the invention in exploded view, including an emergency disconnect package 2 (EDP). As shown in FIG. 5, the EDP 2 is located on top a lower riser package 1 (LRP). The LRP 1 is designed to be landed and secured to a Christmas tree 12 (XMT) located on the seabed and secured to the wellhead. The EDP 2 is able to disconnect in case of an emergency.

A lower dual stripper apparatus 3, also termed a stripper box, is in turn installed above the EDP 2. Such dual stripper apparatus 3 is shown in more detail in FIGS. 3A, 3B and 6. An upper dual stripper apparatus 4 is normally, but not exclusively, located on the surface, on a vessel or a rig. It could be located subsea. A coiled tubing string 5 (CT) extends between the upper and lower dual stripper apparatus 3, 4. A coil tubing cutting device (not shown) can be installed below the upper dual stripper apparatus 4, if required.

FIG. 2 shows the entire assembly in full length, in this example with a distance of approx. 60 meters between the upper and lower dual stripper apparatus.

Figure 3A:
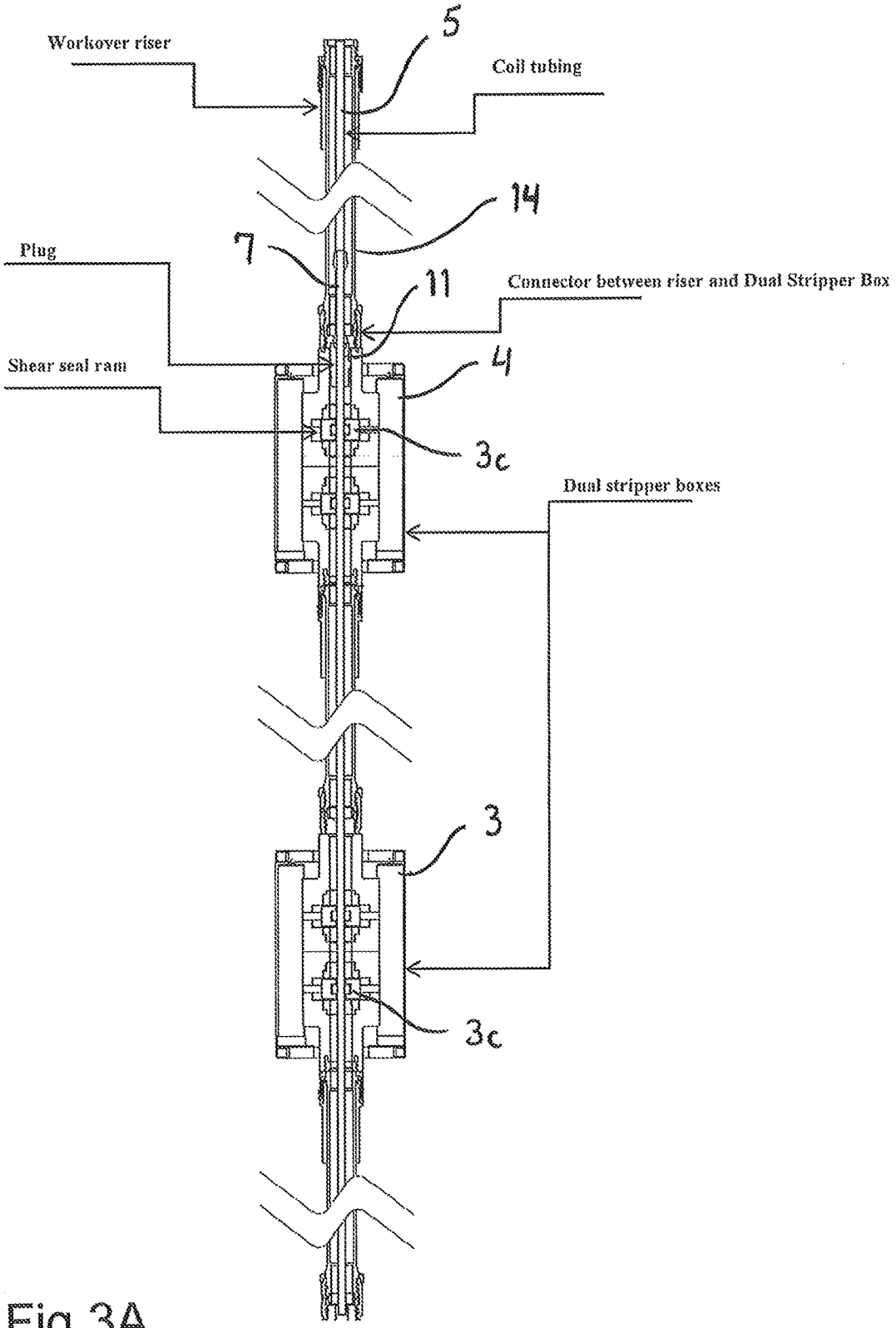
FIG. 3A is a schematic cross section view of the workover arrangement when the plug is above the upper dual stripper apparatus.
Figure 3B:
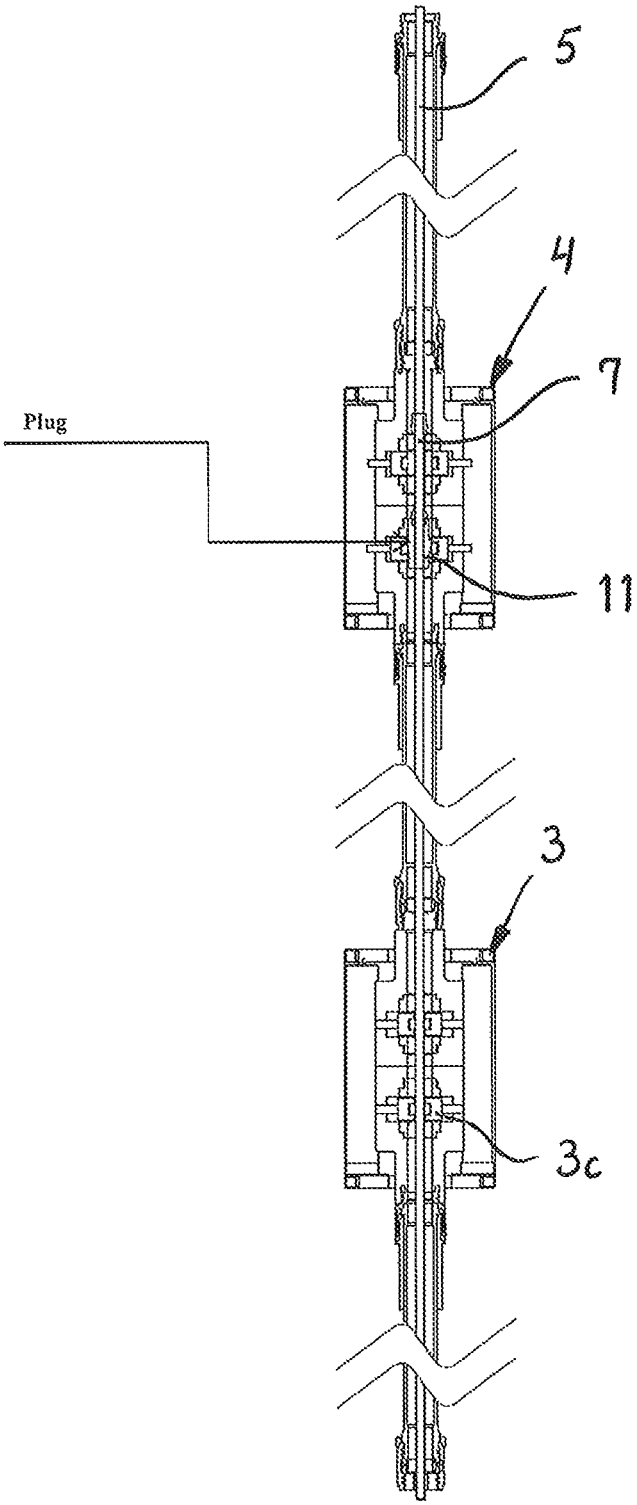
FIG. 3B is a schematic cross section view of the workover arrangement when the plug is passing through the upper dual stripper apparatus.

FIGS. 3A and 3B show the upper dual stripper apparatus 4 in more detail when a running tool 7 is to be advanced through the upper dual stripper apparatus 4. A more detailed description will follow.

Figure 4:
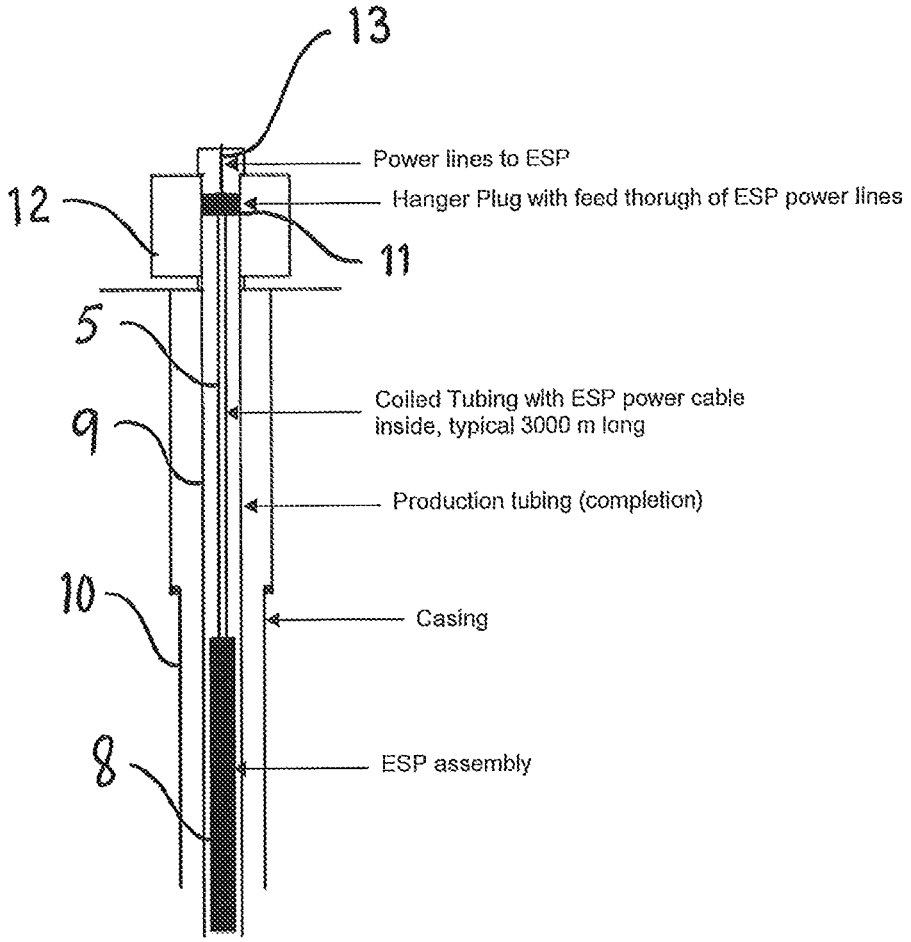
FIG. 4 is a schematic view of an ESP suspended by means of a hanger plug in an XMT.

FIG. 4 shows in a schematic manner how an electrical submersible pump 8 is installed into a production tubing 9, which, in turn, is extending within a casing string 10. The ESP 8 is suspended by a hanger plug 11 located in the XMT 12. Power and signal lines 13 extend internally of the CT 5 from the surface and down to the ESP 8. The ESP 8 can typically be lowered more than 3000 meters into the seabed formation.

With reference to FIG. 5, the entire workover arrangement is schematically shown. The lower riser package 1 (LRP) is installed on top of the XMT 12. The emergency disconnect package 2 (EDP) is in turn installed on top of the LRP 1. A workover riser 14 extends from the EDP up to the surface flow tree (SFT) 15. A surface BOP 6 is arranged above the SFT 15 and the dual stripper apparatus 4 is in turn located above the BOP 6. An injector head 16 is arranged above the dual stripper apparatus 4 and the injector head 16 is able to push the CT 5 downwards and also straighten out the CT 5. Also the hanger plug 11 and the hanger plug running tool 7 are shown above the injector head 16, both suspended in the coiled tubing CT 5.

Figure 6:
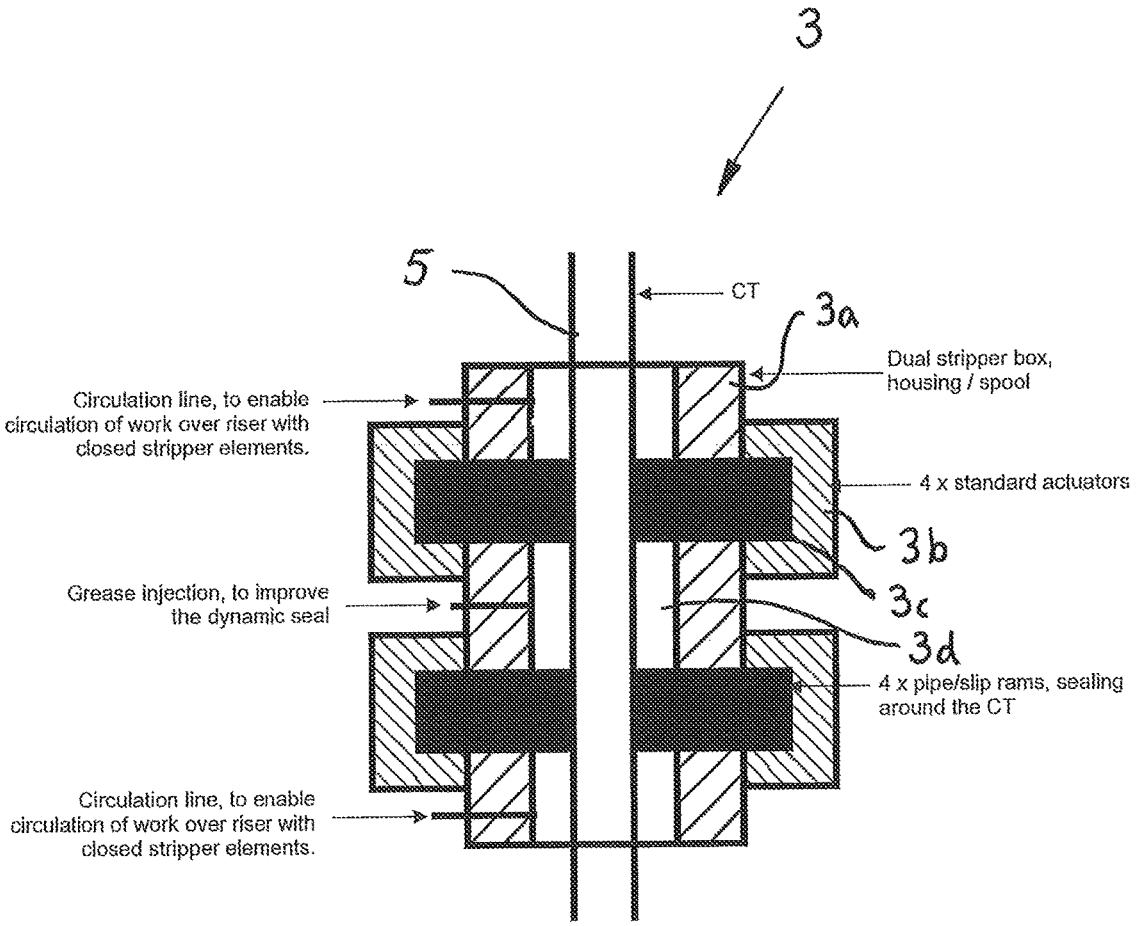
FIG. 6 is a schematic view of a dual stripper apparatus and components.

FIG. 6 shows in schematic and enlarged view a dual stripper apparatus 3 or 4. The apparatus is capable of opening and closing to allow the ESP, hanger plug and RT to pass through. The apparatus 3, 4 includes a housing 3*a* supporting respective actuators 3*b* able to actuate respective pipe/slip rams, arranged in the housing 3*a*. The actuator of the rams 3*c* enables the seals to engage the centrally located tubing string CT 5. A circulation line to enable circulation of work over riser with closed stripper elements is provided, in addition to a circulation line for circulation with closed stripper elements. Also a line to inject grease into a cavity 3*d* between the seals is provided. The pipe rams can open to full bore of 7⅜" to allow large objects (like ESP and Hanger Plug) to pass through. In closed position they will seal around the CT (typical OD size of 2⅜"). To improve the seal of the pipe rams, grease will be injected in between the pipes with a pressure above the well pressure. Any leakage through the dual stripper box will therefore be grease, not hydrocarbons.

Figure 7:
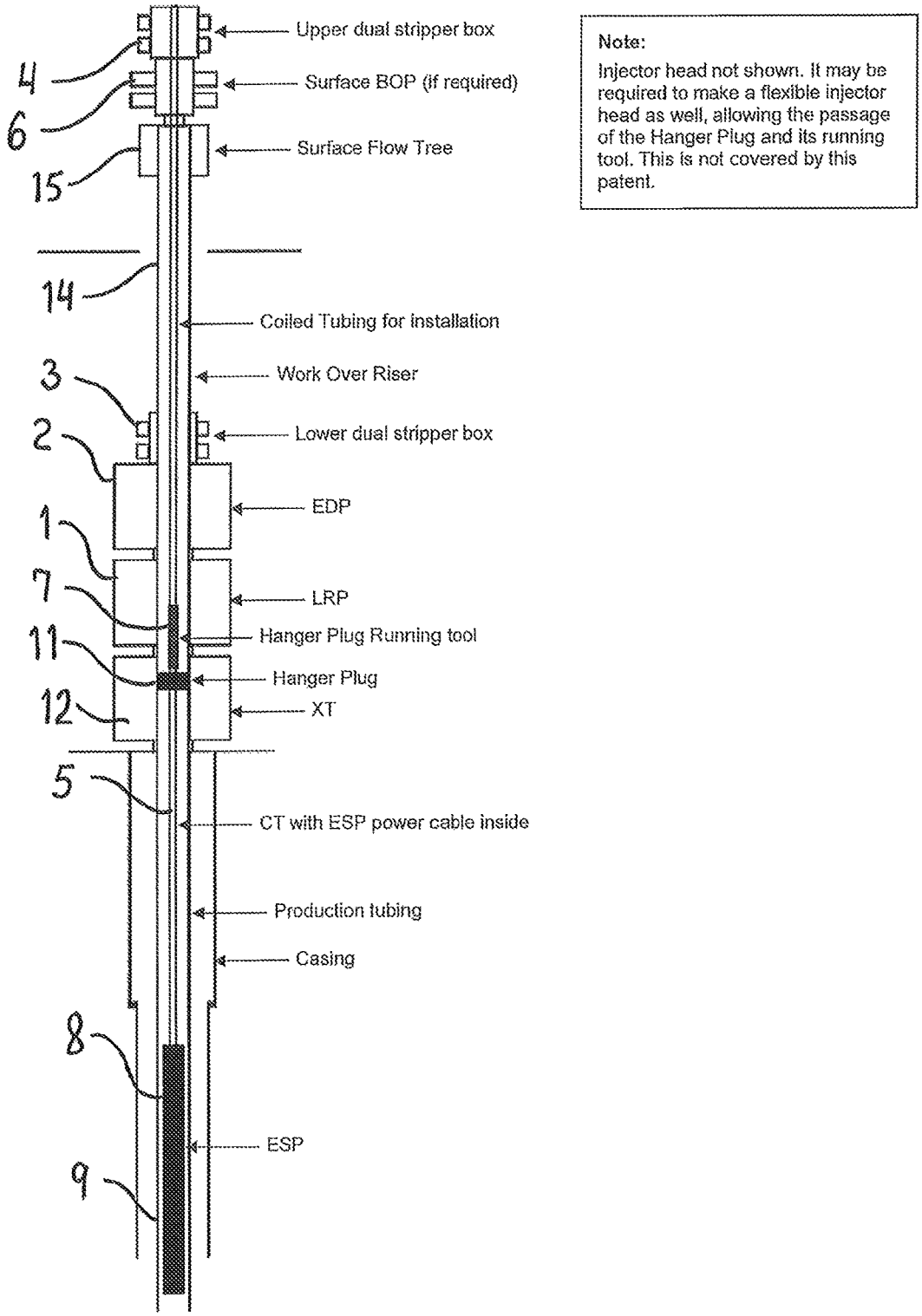
FIG. 7 is another schematic overall view of the workover arrangement according to the invention in combination with the tubing string.

FIG. 7 shows a view with some similarity to FIG. 5. The injector head is not shown, but both upper and lower dual stripper apparatus 3, 4 are shown. Compared to FIG. 5, the ESP 8 is now lowered further into the production tubing 9 and the hanger plug running tool 7 carrying the hanger plug 11 is landed in the XMT 12 located on the seabed. It may be required to make a flexible injector head as well, allowing the passage of the hanger plug 11 and its running tool 7.

The illustration of FIG. 7 shows how the system is built in principle. The positioning of the two dual stripper apparatuses 3, 4 may vary from the illustration. The only two rules for their placement are:

1. One of the stripper boxes must be placed at a distance above the EDP valve at least equal to the length of the ESP. This to allow lowering the ESP through EDP/LRP while keeping pressure control with the stripper box above the ESP.
2. The spacing between the two dual stripper boxes must be equal or greater to the length of the Hanger Plug and the Hanger Plug Running Tool. This is to allow sluicing through the plug and running tool while keeping pressure control with one of the stripper boxes.

One of the dual stripper boxes must be placed at a distance above the EDP valve at least equal to the length of the ESP. This will allow the stripper box to close around the CT after the ESP has passed and before the valves in the EDP/LRP have opened. This will be beneficial since the hanger plug then can be run all the way down to the lower dual stripper box, and then eliminating the need for circulating the riser between the stripper boxes on the installation run.

It is also beneficial to have the two dual stripper boxes as close as possible (slightly greater than the length of the combined hanger plug and running tool) in order to minimize the volume needed to be bled off and circulated during installation/retrieval.

The lowering procedure of the ESP 8 throughout the WOS will now be explained with reference to FIG. 8A to 8H.

Figure 8A:
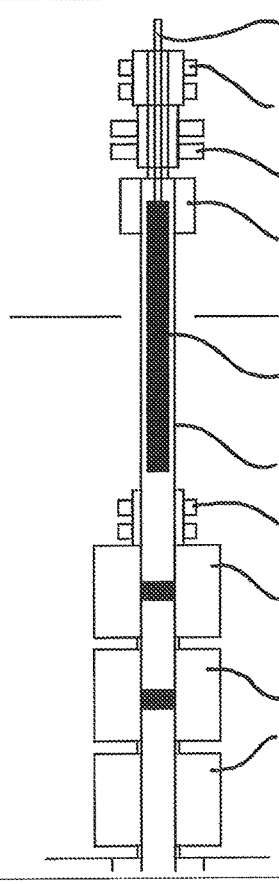
FIG. 8A-8H are schematically illustrated installation steps by use of the workover arrangement according to the invention.

FIG. 8A shows the initial step where the ESP 8 has been lowered through the upper dual stripper apparatus 4, the surface BOP 6 and proceeds through the surface flow tree 15 and is on its way down to the lower dual stripper apparatus 3. In this step both the upper and lower dual stripper apparatuses 3, 4 are open. The valves of the emergency disconnect package 2 (EDP) are closed. Also the valves of the lower riser package 1 (LRP) are closed. The ESP 8 is lowered to just above the EDP 2.

Figure 8B:
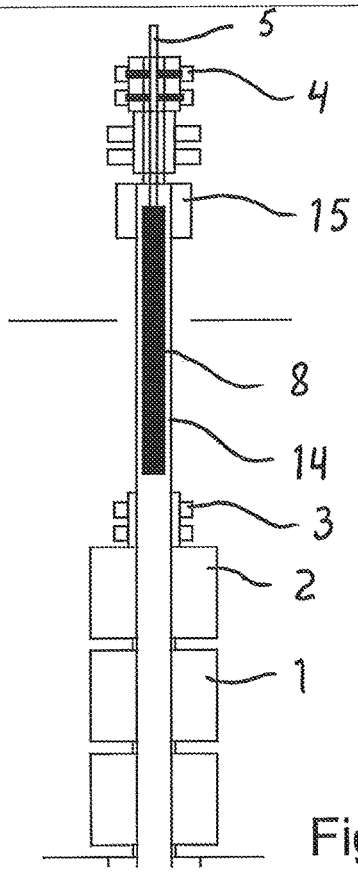

FIG. 8B shows the next and second step. The upper dual stripper apparatus 4 is now closed to seal around the coiled tubing 5 (CT) while the coiled tubing 5 is still able to be advanced in a sealing and sliding way through the upper dual stripper apparatus 4. The workover riser 14 is now pressurized to the well pressure. The valves of the EDP 2 and the LRP 1 are now opened. The ESP 8 is ready to be lowered through the EDP 2 and the LRP 1.

Figure 8C:
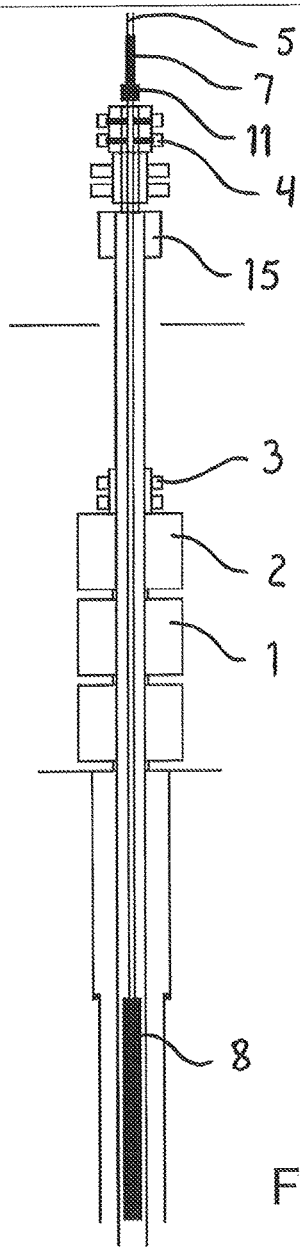

FIG. 8C shows the subsequent and third step. The ESP 8 continues to be lowered until a hanger plug 11 run by a running tool 7 arrives at the upper dual stripper apparatus 4.

Figure 8D:
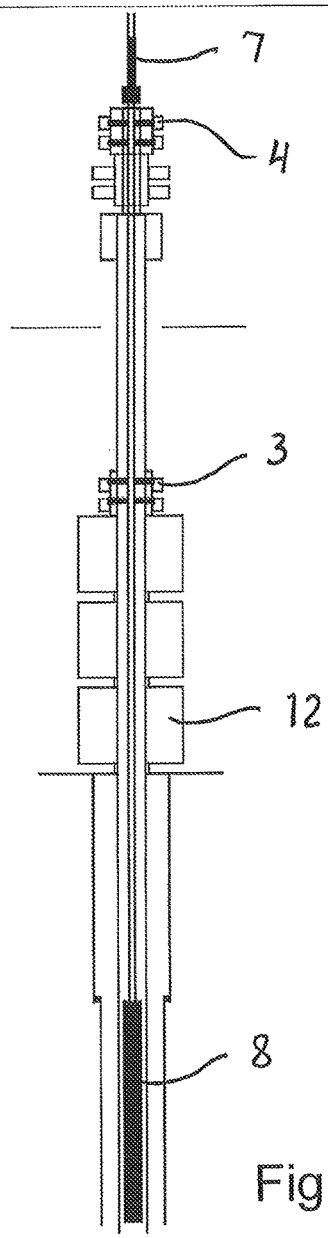

FIG. 8D shows the following and fourth step. Now the lower dual stripper apparatus 3 is activated to have the seals therein closing around the CT 5. The workover riser section between the upper and lower dual stripper apparatuses 3, 4 are bled off and circulated to MEG.

Figure 8E:
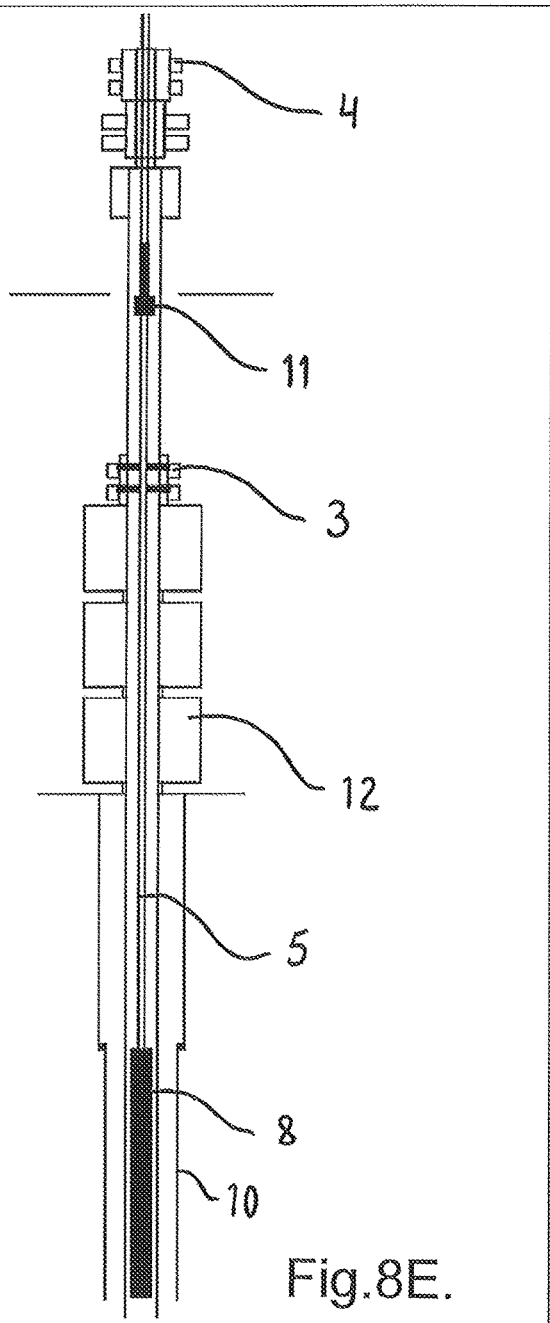

FIG. 8E shows the next and fifth step. Now the upper dual stripper apparatus 4 is opened. The hanger plug 11, connected to the running tool 7, is now lowered through and past the upper dual stripper box 4.

Figure 8F:
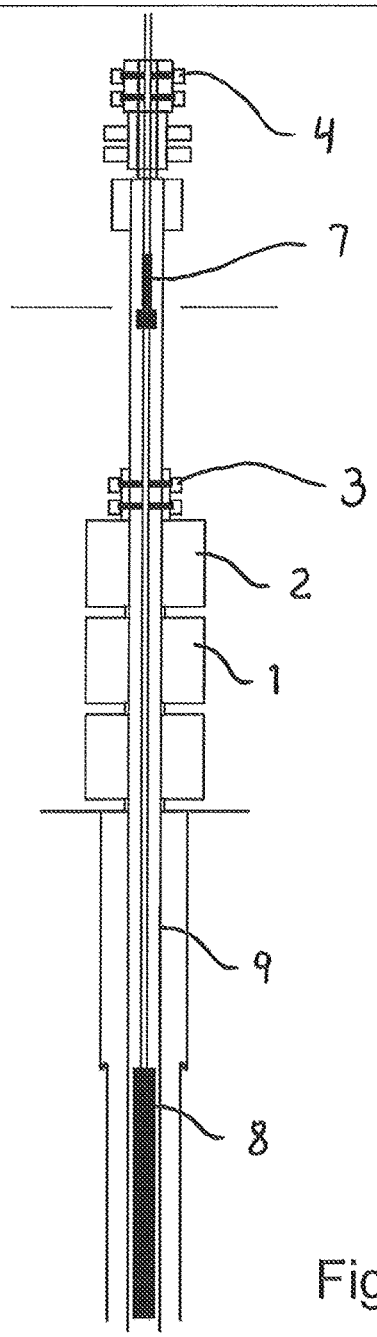

FIG. 8F shows the next and sixth step. The upper dual stripper apparatus 4 is now closed around the coiled tubing 5. The pressure between the upper and lower dual stripper apparatuses 3, 4 is increased to equalize the well pressure.

Figure 8G:
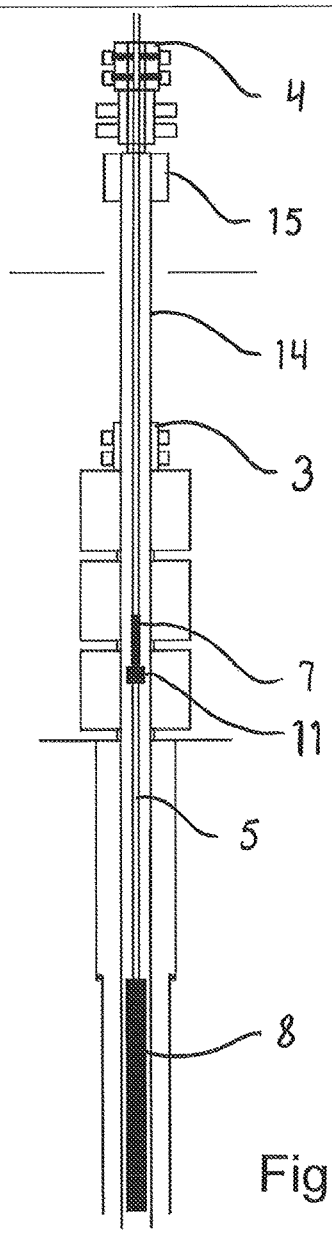

FIG. 8G shows the next and seventh step. Now the seals 3*c* of the lower dual stripper apparatus 3 is opened. The hanger plug 11 and associated running tool 7 are lowered until the hanger plug 11 is landed in the XMT 12. Then the hanger plug 11 is locked to the XMT 12.

Figure 8H:
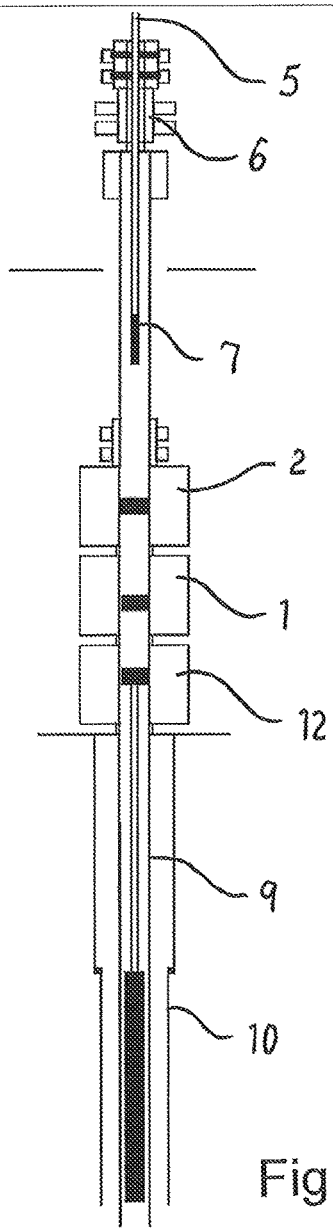

FIG. 8H shows the final and eighth step. This step is optional and is to disconnect the hanger plug 12 and retrieve the running tool 7 to the surface. The valves of the EDP 2 and the LRP 1 are closed. The riser is bled off and circulated to MEG. Finally the upper dual stripper apparatus 4 is opened and the CT 5 and the running tool 7 are retrieved to the surface. The installation procedure is completed and the ESP can be activated to enable the pumping operation to boost the well.

The following abbreviations are used throughout the description and claims:

1. WOS—Work Over System
2. WOCS—Work Over Control System
3. CT—Coiled Tubing
4. ESP—Electrical Submersible Pump
5. SFT—Surface Flow Tree
6. EDP—Emergency Disconnect Package
7. LPR—Lower Riser Package
8. XMT—Christmas Tree
9. LWRP—Lower Workover Riser Package
10. CKV—Choke/Kill Valve
11. MEG—Monoethylene glycol
12. WCP—Well Control Package

The invention claimed is:

1. A workover riser arrangement designed to allow installation/retrieval of a coiled tubing suspended Electrical Submersible Pump (ESP) into a live well defined by an internal wall of a production tubing, by use of a coiled tubing as a running string to be extended through respective apparatuses in said workover riser arrangement and further down towards a bottom of the well, wherein said workover riser arrangement comprises an upper dual stripper apparatus, positioned at an upper end of the workover riser arrangement, through which said coiled tubing is to be extended, a lower dual stripper apparatus, positioned at a lower end of the workover riser arrangement, through which said coiled tubing is to be extended, a surface blowout preventer (BOP) and/or a surface flow tree arranged either between the upper and lower dual stripper apparatuses or above the upper dual stripper apparatus, an emergency disconnect package (EDP), a lower riser package (LRP) and a Christmas tree (XMT) arranged in series below the lower dual stripper apparatus.

2. The workover riser arrangement according to claim 1, wherein said upper and lower dual stripper apparatuses are designed to both seal against a slick surface and still being able to let through an object of larger diameter, each apparatus comprises two independent seal blocks, said seal blocks being located adjacent to each other and retaining respective split seals that are spaced a distance apart from each other and leaving a cavity there between, the cavity is in communication with a high viscosity fluid supply device in order to fill said cavity with high viscosity fluid and pressurize said cavity to form a dual seal.

3. The workover riser arrangement according to claim 1, wherein said upper and lower dual stripper apparatuses comprising two independent seal blocks, the seal blocks are divided in two halves, each half being moveable towards and away from each other.

4. The workover riser arrangement according to claim 3, wherein each seal half is moveable by respective pipe actuators.

5. The workover riser arrangement according to claim 2, wherein each seal is a dynamic seal able to dynamically seal against well pressure.

6. The workover riser arrangement according to claim 1, wherein said ESP has a connected power/signal cable extending inside the coiled tubing between the surface and the ESP.

7. The workover riser arrangement according to claim 1, wherein an isolation plug, or hanger plug, is connected to a plug running tool connected to the coiled tubing, the isolation plug is suspended in the running tool and arranged to be hung off either in a wellhead at the top of the well or the XMT.

8. The workover riser arrangement according to claim 1, wherein one of the upper or lower dual stripper apparatuses is placed at a distance above an EDP valve at least equal to the length of the ESP, in order to enable lowering the ESP through EDP/LRP while keeping pressure control with one of the upper or lower dual stripper apparatus above the ESP.

9. The workover riser arrangement according to claim 1, wherein spacing between the upper or lower dual stripper apparatuses is equal to or greater than the length of a hanger plug and a hanger plug running tool, in order to enable sluicing through the plug and running tool while keeping pressure control with one of the upper or lower dual stripper apparatus.

10. The workover riser arrangement according to claim 2 wherein said upper and lower dual stripper apparatuses comprising the two independent seal blocks, the seal blocks are divided in two halves, each half being moveable towards and away from each other.

11. The workover riser arrangement according to claim 10 wherein each seal half is moveable by respective pipe actuators.

12. The workover riser arrangement according to claim 2 wherein each seal is a dynamic seal able to dynamically seal against well pressure.

13. The workover riser arrangement according to claim 3 wherein each seal is a dynamic seal able to dynamically seal against well pressure.

14. The workover riser arrangement according to claim 4 wherein each seal is a dynamic seal able to dynamically seal against well pressure.

15. The workover riser arrangement according to claim 2 wherein said ESP has a connected power/signal cable extending inside the coiled tubing between the surface and the ESP.

16. The workover riser arrangement according to claim 3 wherein said ESP has a connected power/signal cable extending inside the coiled tubing between the surface and the ESP.

17. The workover riser arrangement according to claim 4 wherein said ESP has a connected power/signal cable extending inside the coiled tubing between the surface and the ESP.

18. The workover riser arrangement according to claim 2, wherein said slick surface is a coiled tubing string.

19. A method for installing a coiled tubing suspended Electrical Submersible Pump (ESP) into a live well defined an internal wall of a production tubing, the method uses a coiled tubing string as a running string to be extended through a workover riser arrangement and further down towards a bottom of the well, the workover riser arrangement includes an upper dual stripper apparatus positioned at an upper end of the workover riser arrangement, through which said coiled tubing is to extend, a lower dual stripper apparatus positioned at a lower end of the workover riser arrangement, through which said coiled tubing is to extend, a surface blowout preventer (BOP) and/or a surface flow tree arranged between the upper and lower dual stripper apparatuses, an emergency disconnect package (EDP), a lower riser package (LRP) and a Christmas tree (XMT) arranged in series below the lower dual stripper apparatus, wherein said method comprises the following steps:

1. lowering the ESP through the upper dual stripper apparatus while both upper and lower dual stripper apparatuses are open and EDP/LRP valves are closed and the ESP is lowered to above the EDP;
2. closing the upper dual stripper apparatus, pressurize the workover riser arrangement to well pressure, open the EDP/LRP valves and lowering the ESP through the EDP/LRP;
3. continue the lowering of the ESP until a hanger plug arrives at the upper dual stripper apparatus;
4. the lower dual stripper apparatus closes around the coiled tubing while the riser between the upper and lower dual stripper apparatuses are bled off and circulated to monoethylene glycol (MEG);
5. the upper dual stripper apparatus is opened, the hanger plug with associated running tool is lowered through and past the upper dual stripper apparatus;
6. the upper dual stripper apparatus is closed, the pressure between the upper and lower dual stripper apparatuses is increased to equalize the well pressure; and
7. the lower dual stripper apparatus is opened, the hanger plug and running tool is lowered until the hanger plug is landed in the XMT, and the hanger plug is locked to the XMT.

20. The method according to claim 19, wherein the method further includes a step 8:

to retrieve the running tool above the EDP/LRP, close the EDP/LRP valves, bleed off and circulate the riser to MEG, and finally open the upper dual stripper apparatus and retrieve CT and running tool to the surface.

* * * * *